US010029768B2

(12) United States Patent
Marcireau

(10) Patent No.: US 10,029,768 B2
(45) Date of Patent: Jul. 24, 2018

(54) DEVICE FOR BLOCKING OR SEALING AN OPENING IN A WALL

(71) Applicant: Daniel Marcireau, Carry le Rouet (FR)

(72) Inventor: Daniel Marcireau, Carry le Rouet (FR)

( * ) Notice: Subject to any disclaimer, the term of this patent is extended or adjusted under 35 U.S.C. 154(b) by 0 days.

(21) Appl. No.: 15/309,984

(22) PCT Filed: Apr. 30, 2015

(86) PCT No.: PCT/FR2015/051165
§ 371 (c)(1),
(2) Date: Nov. 9, 2016

(87) PCT Pub. No.: WO2015/181460
PCT Pub. Date: Dec. 3, 2015

(65) Prior Publication Data

US 2017/0137096 A1 May 18, 2017

(30) Foreign Application Priority Data

May 26, 2014 (FR) ..... 14 54746

(51) Int. Cl.
*B63B 43/16* (2006.01)

(52) U.S. Cl.
CPC ..... *B63B 43/16* (2013.01)

(58) Field of Classification Search
CPC ..... B63B 43/16
USPC ..... 114/227–229
See application file for complete search history.

(56) References Cited

U.S. PATENT DOCUMENTS 1,260,978 A * 3/1918 Henslee ..... B63B 43/16 114/229
5,058,519 A 10/1991 Collins
5,253,602 A 10/1993 Moriarty
5,277,143 A * 1/1994 Frangulea ..... B63B 43/16 114/227
5,305,702 A 4/1994 Phillips
7,121,054 B2 * 10/2006 Shock ..... E04G 23/0203 52/514.5

(Continued)

FOREIGN PATENT DOCUMENTS

DE 199 57 445 5/2001
FR 2743347 7/1997
FR 2808499 11/2001

(Continued)

OTHER PUBLICATIONS

International Search Report dated Oct. 12, 2015 out of PCT priority Application No. PCT/FR2015/051165 (6 pages including English translation).

(Continued)

*Primary Examiner* — Ajay Vasudeva
(74) *Attorney, Agent, or Firm* — Brinks Gilson & Lione; John C. Freeman

(57) ABSTRACT

A device for sealing an opening in a wall includes at least one flexible, deformable balloon; a locking bar that is slidable into the opening of the wall from one side of the latter and engages with the opposite side of said wall; a plate capable of bearing on the at least one balloon and of sandwiching same against the wall; and a flexible connecting rope located between the locking bar and the plate and that passes through an inner duct of the balloon and is capable of compressing the balloon against the opening.

8 Claims, 3 Drawing Sheets

(56) References Cited

U.S. PATENT DOCUMENTS 8,689,717 B2 4/2014 Benveniste

FOREIGN PATENT DOCUMENTS

| | | |
|---|---|---|
| WO | WO 88/08389 | 11/1988 |
| WO | WO 2009/123383 | 10/2009 |

OTHER PUBLICATIONS

Written Opinion dated Oct. 12, 2015 out of PCT priority Application No. PCT/FR2015/051165 (5 pages).

* cited by examiner

DEVICE FOR BLOCKING OR SEALING AN OPENING IN A WALL

This application claims priority to International Application No. PCT/FR2015/051165 filed Apr. 30, 2015 and to French Application No. 1454746 filed May 26, 2014; the entire contents of each are incorporated herein by reference.

The subject matter of the present invention is a device for blocking or sealing a hole in a wall.

BACKGROUND

The technical field and the main application of the invention relate to the fabrication and the use of devices in emergency situations to block or seal, from the inside, accidental leaks in the hull or the deck of a boat which is on the water, although such a device may equally be used to block or seal an accidental hole in a tank such as a fuel tank, and in this case from the outside of that tank.

It is in fact known that a leak in a boat hull is a problem that can lead to its loss, even when sailing near the coast, and that often necessitates, over and above the intervention of the crew, to the help of exterior rescue means: thus this is the third cause of interventions by the crews of the French rescue service Société Nationale des Sauveteurs en Mer (SNSM). In 2002 the leaks of all types, including hull breaches, were the second cause of intervention by the United States Coast Guard, with 500 incidents causing 111 fatalities and more than 11 million dollars of material damages.

Although not obligatory since the updating of the French regulations (in division 240), the presence onboard pleasure vessels of a system for blocking or sealing leaks in an emergency is still widely recommended. The equipment available at present is limited to narrow breaches, however, and to the closing of through-hull fittings, thus of circular section.

There are in fact known various products developed and marketed for blocking or sealing leaks, such as wood plugs suited only to circular holes of small diameter: in practice their use is therefore limited to blocking or sealing through-hull fittings and valves.

There have also been developed flexible plugs such as those described in U.S. Pat. No. 8,689,717 (Artelier Studio), marketed under the trade mark "Truplug®", and which are used in the same way as wooden plugs: they are described as being equally useful for larger, irregular and long breaches, but then use either a plug cut lengthwise or a plurality of these plugs, but then necessitate combining them with pumps because they cannot make a good seal; moreover tests on the water have cast doubt on their effectiveness.

Also known are systems that are inserted into the breach that has opened up in the hull and part of which is deployed externally like an umbrella; there may be cited in this field:

U.S. Pat. No. 5,253,602 (John B. Moriarty), which teaches a system comprising a rigid threaded shaft sheathed with a circular sleeve over which slides a collar articulated with ribs disposed like the spokes of a wheel, supporting an impermeable membrane; inserted through the breach, the system is opened like an umbrella and then pulled to block or seal the hole on the outside of the hull by pressing the membrane against the latter; the seal that is produced in this way can be improved by screwing a rigid cover onto the interior part of the rod after removing the handle and an annular air chamber may also be disposed between this cover and the umbrella, around the threaded rod and inflated to fill the gap with it.

Patent application WO88/08389 (Barelier) describing a "self-sealing functional plug device", consisting of three elements that are threaded through the hole that it is required to block or seal and part of which is deployed on the outside like an umbrella to provide pressure resistance and a seal, but as in the previous patent a system of this kind is of a mechanical complexity that makes it difficult to use.

There may also be cited U.S. Pat. No. 5,305,702 (Donald E. Philips), which teaches a rigid central shaft inserted through the breach and attached to the outside of the hull by articulated lugs, the mechanical compression of an interior cover, the nature of which is not specified, being produced by a traction handle and then a locking collar: the seal is provided by a circular pneumatic seal fastened to the periphery of the cover, which may be associated with capsules that can be split open or inflated by compressed air.

There may finally be cited various devices that attempt to plug the hole by an expansion of volume within that hole such as in the patent FR 2808499 (Acquaviva) which teaches an inflatable element that is inserted into the hole and that is inflated with compressed air or gas. The patent FR 2743347 (Montel) moreover describes a polymerizable substance reacting rapidly by expanding on contact with water which is therefore inserted into the hole to block it: a product of this kind is limited by its application method, which can only be manual, and to small holes, because it is necessary to hold the product for the time it takes to polymerize and to expand while attempting to maintain the pressure of the water and the seal, which is not easy to do at the same time.

Although, like the present invention, all these products or devices have the objective of blocking or sealing a hole causing, in the case of a boat, a leak in a wall, they all have at least one of the following disadvantages:

their use is complicated and/or limited by the force caused by the pressure of the water as soon as the hole is more than a few centimeters in diameter, it is not really possible to block or seal irregular breaches with most of these products, the restrictive application to a plane surface, either on the outside of the hull, which is not always the case (breach in the stem, close to the keel or the rudder stock, the propshaft, etc.), or on the inside, which is never the case in modern pleasure boats, the use of a rigid central shaft and threaded, sliding or articulated metal parts in contact: a system of this kind is difficult to use below the waterline of a ship in rough sea that is shipping water, and is liable to become jammed and to premature ageing when stored in a salty environment, the necessary insertion of a more or less voluminous and fragile part of the system (umbrella, balloon, articulated anchor system) through the breach, impossible in practice because on the one hand of the high flow rate of water through even a small breach and on the other hand in the case of a narrow fissure, blocking or sealing the hole from the outside of the hull possibly necessitating placement or at least checking by a diver, which is very restrictive in an emergency situation, and not easily compatible with continuing to sail the ship, the necessary adaptation of the size and weight of the rigid parts of the system to the maximum area that it is required to block or seal, with the consequences thereof in respect of ease of use, overall size and weight in storage, and price.

The problem is therefore to answer these disadvantages and limitations of the existing systems, namely to block or seal, from inside a ship's hull, holes up to at least 20 $dm^2$ (and therefore even larger), that are not only of circular shape but also of irregular shape (possibly being produced by an impact and/or a hull breach), with non-plane internal and external wall surfaces, with no complex mechanical parts nor insertion of a large and/or fragile part through the hole, and that is easy to use, of low cost and small overall size, and able to adapt to different sizes of holes to be blocked or sealed.

SUMMARY

One solution to the stated problem is a device for blocking or sealing a hole in a wall, comprising at least one flexible and deformable balloon, locking means adapted to be threaded into the hole in the wall from one side thereof and to come to press against the opposite side of that wall, a pressing means able to press on the at least one balloon and to sandwich the latter against the wall, and connecting means between the locking means and the pressing means, such as the locking means comprises a bar, the pressing means is a circular plate through which the connecting means pass and the latter is a flexible cord that is fastened by a locking system to the circular plate and the traction whereof on the locking bar compresses the balloon against the hole.

In one particular embodiment, the device in accordance with the invention comprises a single balloon including an interior duct through which the flexible connecting cord passes and in another embodiment the device in accordance with the invention comprises at least two balloons assembled one against the other and delimiting between them a space forming a duct through which the flexible connecting cord passes.

Another solution to the stated problem is a method of blocking or sealing a hole in a wall, characterized in that:

a bar is threaded into the hole in the wall from one side thereof, constituting locking means that are positioned against the opposite side of the wall around the hole, this locking bar is connected by a flexible connecting cord to a circular plate constituting a pressing means that sandwich against the wall at least one flexible and deformable balloon positioned on the opposite side of the wall relative to that on which the locking means are placed, the at least one balloon is compressed against the hole by traction on the flexible cord that is fastened by a locking system to the circular plate, crushing the at least one balloon by the pressing of the circular plate on it.

In a preferred embodiment the balloon or balloons is or are inflatable and is or are inflated after placing against the hole to be blocked or sealed on the one hand the latter balloon and on the other hand the circular plate adapted to compress this balloon or these balloons when it or they are inflated and to sandwich the latter against the wall.

In the main and most appropriate application of the invention, the wall is that of the hull of a boat or ship, primarily a pleasure craft or fishing boat.

The result is a new device and a new method for blocking or sealing a hole in a wall that are simple to use and that answer to the stated problem and the disadvantages of existing devices and methods.

In fact, the present invention offers numerous advantages such as:

greater mixed compression (circular plate+inflated balloon), more important, a larger area of contact against the wall around the hole, more extended, the small overall size of the locking/attachment bar, the absence of metal parts in contact, the flexibility of the compression and locking system (no rigid shaft), the possibility of using the device "remotely", i.e. without necessitating numerous manipulations near and/or directly in the hole, it applies a force and then maintains a seal sufficient to oppose the pressure of the water (up to a reasonable depth, as specified hereinafter) and leaks, respectively, the volume of the balloon or balloons and the mode of action thereof make it adaptable to any leak even in the case of large and irregular and not only circular breaches, such as up to at least 20 $dm^2$.

It is nevertheless certain that its use is limited to leaks near the surface i.e. to a water pressure corresponding to a depth of at most 5 m, for example, which already produces a force of 50 kg for a 100 $cm^2$ hole (corresponding to a square 10 cm×10 cm).

Moreover, the device and the method according to the invention allow rapid use, necessary in an emergency situation at the time of an accident such as the boat colliding with an object floating on the surface: such a device can therefore constitute standard nautical safety equipment; the insertion of a simple exterior bar through the breach is in fact easy and fast, its effective and immediate anchoring then making it possible to apply an uninflated balloon by causing the plate to slide along the cord (the operator applying strong pressure with their feet, for example), after which the balloon can be strongly inflated until a complete seal is obtained.

Similarly, this device can be used from the outside of a tank, either on land or at sea in the event of a shipwreck, to prevent inter alia a fuel leak: the use of the device is then simply reversed, the locking means being placed inside the tank and the balloon or balloons coming to press against its outside wall. In this application to the situation involving a fuel tank the materials of the device must be resistant to hydrocarbons for the fuel tank situation, but in the case of a leak from a water tank on land, for example, this is naturally not necessary.

It is also possible to use one or more impermeable foam balloons, which are therefore not inflatable but flexible and deformable, with of course an interior duct passing completely through it or them: it is specified that this duct, which is inside a single balloon or defined by a gap delimited between a plurality of back-to-back balloons, is flexible and deformable, and is also, at the time of compression of the balloon or balloons, crushed against the connecting means that pass through it, thus sealing the latter and preventing water or other fluid passing through this duct.

In the case of a foam balloon, and for that matter even if the balloon is inflatable, although in this case it is undoubtedly more bulky and more fragile, the balloon may also serve as a fender to protect the hull of the ship by inserting it between the latter and any wall the ship may come alongside (quay, other ship, etc.).

All of the above features and those described hereinafter offer numerous advantages and show the novelty and the benefit of the device and method according to the invention.

BRIEF DESCRIPTION OF THE DRAWINGS

The description and the appended drawings represent one non-limiting embodiment of the invention: other embodiments are possible within the scope and the extent of this invention, in particular using two balloons back-to-back or three balloons arranged like a trefoil or even more balloons.

DESCRIPTION

Figure 2:
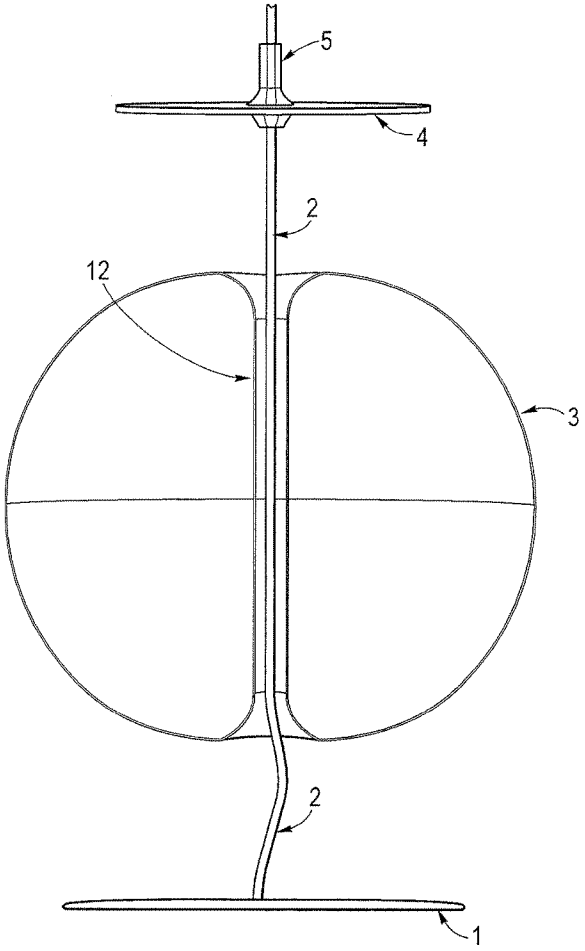
FIG. 2 is a view of the device from FIG. 1 in section on a plane passing through the axis of the interior duct of the balloon.
Figure 1:
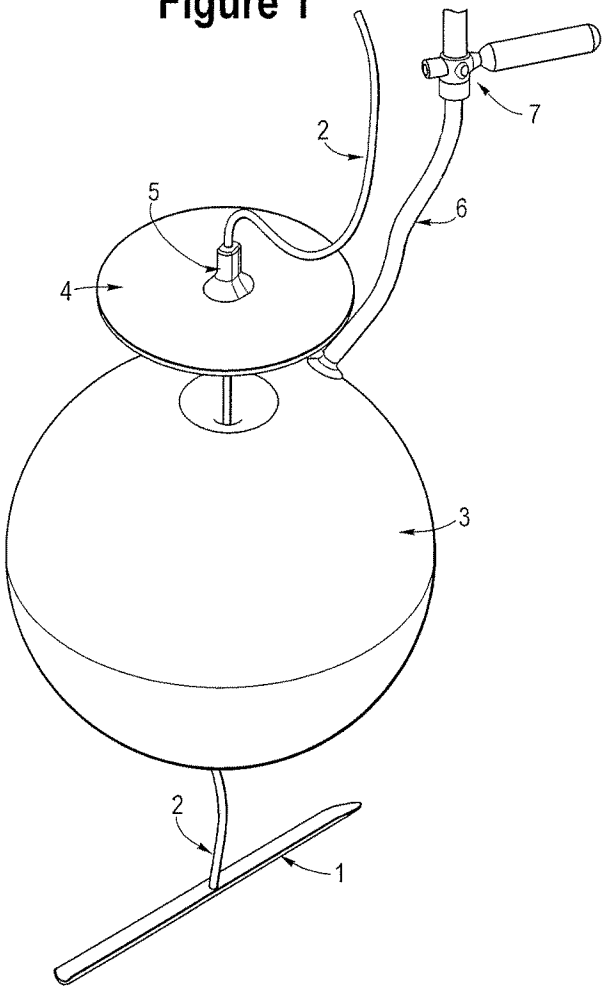
FIG. 1 is a perspective view of one example of a device in accordance with the invention with a single inflatable balloon through which a duct passes, shown in an assembled position but before it is used.
Figure 4:
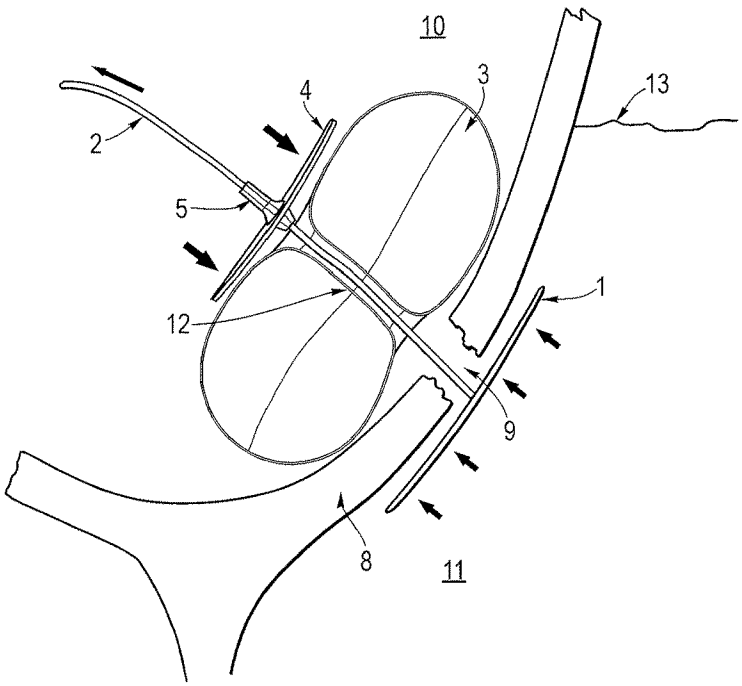
FIG. 4 is a sectional view of the device from FIG. 3 on a plane passing through the axis of the interior duct of the balloon as in FIG. 2 and at the time of compressing the balloon, which will then come to block or seal the hole in the hull.
Figure 3:
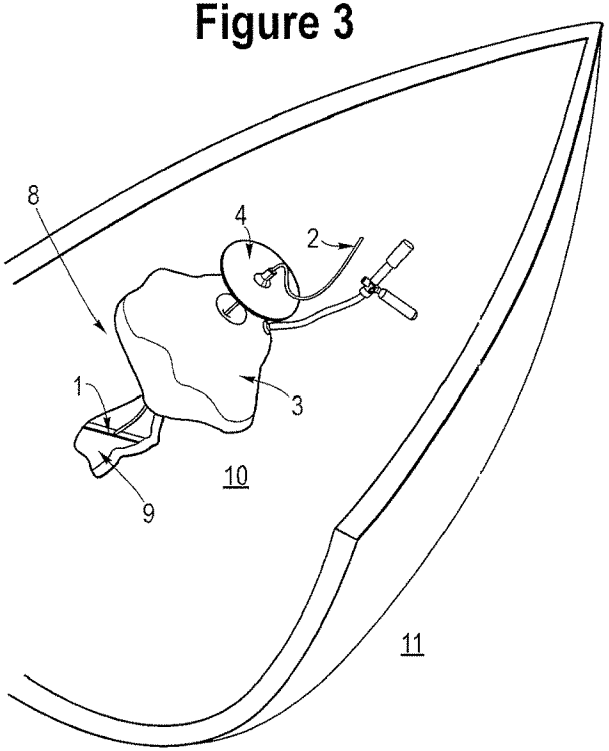
FIG. 3 is a perspective view of the example of the device from FIGS. 1 and 2 in a position of use for blocking or sealing a hole such as a leak in a ship's hull.

In this embodiment, the device represented in FIGS. 3 and 4 for blocking or sealing a hole 9 in a wall 8 such as that of a boat or ship comprises:

a single flexible and deformable balloon 3 including an interior duct 12 that is sealed from the remainder of the volume of the balloon, which duct 12 is preferably axial, i.e. passes through the centre of the volume of the balloon, which may be of quasi-spherical shape and for example of 50 cm diameter, which balloon may be made of PVC approximately 0.7 mm thick, a locking means 1 adapted to be slipped into the hole 9 in the wall 8 from one side 10 thereof, said locking means 1 comprising a metal, e.g. aluminum bar, and enabling immediate and effective anchoring/locking against the wall 8 around the hole 9, a pressing means 4 which is a circular, for example polyethylene, plate through the centre of which pass connecting means 2, and said connecting means 2, which is a cord such as a textile cord, between the locking means 1, i.e. said bar 1, and the pressing means 4, i.e. the circular plate 4, said connecting means 2 passing through the duct 12 and being adapted to enable compression of the balloon 3 against the hole 9 by traction on the locking means 1 and by sandwiching the balloon 3 between the pressing means 4 and the wall 8.

To provide said compression, the circular plate 4 is caused to slide along the cord 2 and said plate 4 is then pressed against the balloon 3 by a simple strong pressure of the feet, which already provides rapid blocking or sealing of the hole 9.

To maintain thereafter the pressing means or circular plate 4 at the resulting distance from the wall 8, the locking device includes a system 5 for locking the connecting means 2 relative to the pressing means or circular plate 4, thus fastening the connecting means 2 to the pressing means 4 at this distance from the partition 8. If the balloon is inflatable, it may then be more strongly inflated until a complete seal is produced, either manually (which is possible in 10 seconds maximum) or by a gas cartridge (even faster).

The distance between the circular plate 4 and the wall 8 may be a given distance required for a deformable and non-inflatable flexible balloon and combined with the inflation pressure of the balloon if the latter is inflatable or with the hardness of its foam if it is not inflatable, and must compress the balloon 3 against this wall and therefore over the hole 9, which is therefore blocked or sealed, at a value adapted to oppose the force of the pressure of the outside water; this distance may be evaluated and adjusted by the operators themselves.

To enable the inflation of the balloon, the latter is equipped with an inflation pipe 6 with a check valve and a three-port valve 7 used to fit an inflator or a manual pump or a gas cartridge; the valve 7 also includes a deflation valve.

The surface of the balloon 3 intended to be applied to the hole 9 or breach is preferably covered with a woven fabric coated with resin or any other product that hardens in contact with water in order to complete the sealing of the device at the contours of the breach or hole 9.

Figure 6:
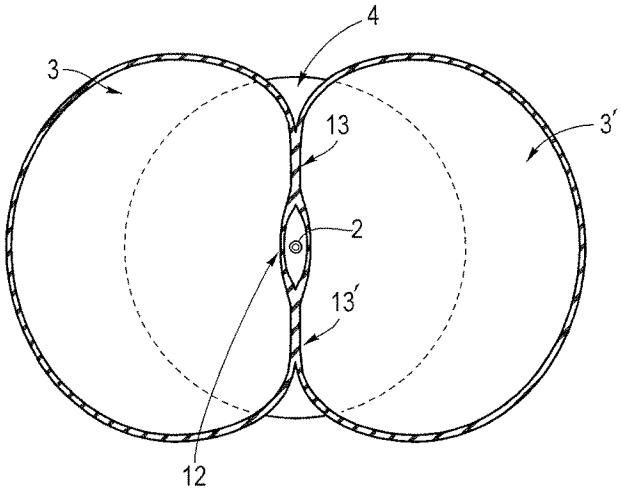
FIG. 6 is a section view of the device of FIG. 5 along line VI-VI.
Figure 5:
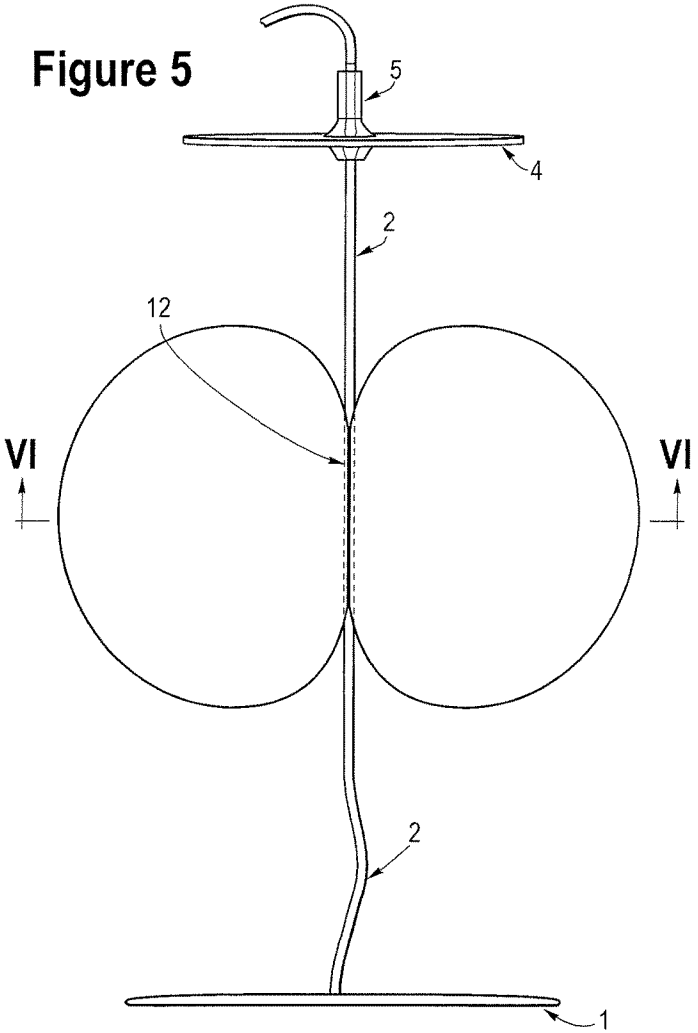
FIG. 5 is a view of another embodiment of the device in section on a plane passing through the axis of a duct disposed between two balloons assembled against one another.

An example of an embodiment using two balloons is shown in FIGS. 5 and 6. Two balloons 3, 3' are assembled one against the other at 13, 13' and delimit between them a space 12 forming a duct through which the flexible connecting cord 2 passes. Embodiments using two or three or more balloons back-to-back are not represented in the present embodiment that describes only a device with only one balloon, but their production technique and their method of use are the same as those described above and represented in the appended figures and are therefore part of the present invention.

The invention claimed is:

1. A device for blocking a hole in a wall, comprising:

at least one flexible and deformable balloon, a single one-piece locking bar having opposed ends and adapted to be threaded into the hole in the wall from one side thereof and to come to press against an opposite side of the wall such that the single one-piece locking bar spans the hole, a plate configured to press on the at least one balloon to sandwich the balloon against the wall, and a flexible cord connecting the locking bar and the plate, the flexible cord attached to the locking bar between the opposing ends passing through the plate, and fastened to the plate, wherein traction on the locking bar compresses and seals the balloon against the hole.

2. The device for blocking according to claim 1, wherein the at least one balloon includes an interior duct through which the flexible connecting cord passes.

3. The device for blocking according to claim 1, comprising at least two balloons assembled against one another and delimiting between them a space forming a duct through which the flexible connecting cord passes.

4. The device for blocking according to claim 1, wherein the at least one balloon is inflatable after placing the at least one balloon and the plate against the hole, sandwiching the at least one balloon against the wall.

5. The device for blocking according to claim 1, wherein the wall is a hull of a boat.

6. The device for blocking according to claim 1, wherein the flexible cord is connected to the locking bar at about a midpoint of the locking bar.

7. A method of blocking a hole in a wall, comprising:

threading a single one-piece locking bar into the hole in the wall from one side thereof, wherein the locking bar has opposing ends;

positioning the locking bar against an opposite side of the wall around the hole such that the single one-piece locking bar spans the hole;

providing at least one flexible and deformable balloon;

connecting a first end of a flexible connecting cord to the locking bar at a location between the opposing ends and connecting a second end of the flexible connecting cord to a plate, wherein the plate is configured to sandwich the at least one flexible and deformable balloon against a side of the wall opposite a side of the wall that the locking bar is positioned; and compressing the at least one balloon against the hole by traction on the flexible cord.

8. The method according to claim 7 wherein the compressing deforms the at least one balloon to seal the hole.

* * * * *